United States Patent [19]

Calandra, Jr.

[11] Patent Number: 4,784,531

[45] Date of Patent: Nov. 15, 1988

[54] BENDABLE ROOF BOLT WITHOUT NOTCH

[75] Inventor: Frank Calandra, Jr., Pittsburgh, Pa.

[73] Assignee: Jennmar Corporation, Pittsburgh, Pa.

[21] Appl. No.: 56,581

[22] Filed: May 29, 1987

[51] Int. Cl.[4] ..... E21D 20/02

[52] U.S. Cl. ..... 405/261; 29/155 R; 29/460; 29/469.5; 72/362; 72/367; 405/259; 405/303

[58] Field of Search ..... 405/260, 259, 261, 303; 72/316, 367, 362, 409, 410; 29/469.5, 460, 155 R

[56] References Cited

U.S. PATENT DOCUMENTS

| | | | |
|---|---|---|---|
| 3,324,662 | 6/1967 | McLean | 405/261 |
| 3.394,527 | 7/1968 | McLean | 405/261 X |
| 3,505,824 | 4/1970 | White | 405/259 |
| 4,079,592 | 3/1978 | Eakin | 405/260 |
| 4,085,492 | 4/1978 | Stange | 405/259 X |
| 4,589,803 | 5/1986 | Totten | 405/259 |
| 4,643,619 | 2/1987 | Issakainen | 405/260 X |

FOREIGN PATENT DOCUMENTS

| | | | |
|---|---|---|---|
| 3507089 | 8/1986 | Fed. Rep. of Germany | 405/260 |

*Primary Examiner*—Dennis L. Taylor

*Attorney, Agent, or Firm*—Stanley J. Price, Jr.

[57] ABSTRACT

A bendable roof bolt is provided for use in a mine at locations where it is desired to utilize a roof bolt having an overall length greater than the available vertical working distance between a mine floor and mine roof. The bendable roof bolt is made from a rebar material and has a preselected length greater than the available vertical working distance between the mine floor and mine roof. The rebar has a uniform cross section over its entire length. Prior to inserting the bendable roof bolt in a bore hole drilled in the mine roof, the roof bolt is bent by suitable means at a predetermined location along the rebar preselected length to allow the end of the bendable roof bolt to be inserted in the bore hole. After the roof bolt is bent and the roof bolt end inserted in the bore hole, the roof bolt is rebent to partially straighten the roof bolt and allow the remainder of the roof bolt to be advanced in the bore hole.

9 Claims, 2 Drawing Sheets

BENDABLE ROOF BOLT WITHOUT NOTCH

BACKGROUND OF THE INVENTION

1. Field of the Invention

This invention relates to a method and apparatus for supporting a mine roof, and more particularly, to a bendable roof bolt having a preselected length and a uniform cross section which may be bent at a predetermined location along the roof bolt preselected length to permit a portion of the roof bolt to be inserted in a bore hole and thereafter partially straightened to allow the remainder of the roof bolt to be advanced in the bore hole.

2. Description of the Prior Art

It is well known in the art of mine roof support to insert a roof bolt in a bore hole drilled in a mine roof and thereafter anchor the roof bolt within the bore hole to reinforce the unsupported rock formation above the roof. However, due to the unstable condition of the rock strata above the mine roof, it is sometimes necessary to drill a bore hole in the mine roof to a depth greater than the available vertical working distance between the mine floor and the mine roof in order to reach rock strata capable of sufficiently anchoring the roof bolt within the bore hole.

When this situation occurs, it is necessary to provide a roof bolt having an overall length greater than the available vertical working distance between the mine floor and mine roof. Since the roof bolt has an overall length greater than the vertical working distance between the mine floor and mine roof, the roof bolt must be bent to reduce its overall length and permit an end portion of the roof bolt to be inserted in the bore hole. After the roof bolt is bent and the end portion inserted in the bore hole, the roof bolt is straightened to allow the remainder of the roof bolt to be advanced in the bore hole.

Bendable roof bolts are presently commercially available for use in locations where a roof bolt having an overall length greater than the available vertical working distance between the mine floor and mine roof is required to reinforce the unsupported rock formation above the roof. In one commercial embodiment of the presently available bendable roof bolt, the roof bolt body includes a notched-out area positioned at a preselected location along the length of the roof bolt to reduce the diameter of the roof bolt and thus facilitate bending before the roof bolt is inserted in the bore hole. In another commercial embodiment, the roof bolt includes a pair of notched-out areas, the pair of notched-out areas being located opposite from each other around the circumference of the roof bolt. The pair of notches are positioned opposite from each other to reduce the diameter of the roof bolt and further facilitate bending of the roof bolt before insertion in the bore hole.

Although bendable roof bolts are commercially available, these roof bolts are expensive to produce since forming a notch in the body of the roof bolt requires either heating and pressing the roof bolt, milling the roof bolt body, or reduced rolling the roof bolt at the area of the notch. Reduced rolling the roof bolt to form the notch may be done by either a hot or cold rolling process. In addition, since the diameter of a notched roof bolt is reduced at the location of the notch, the mechanical properties of the notched roof bolt are a function of the roof bolt diameter at the location of the notch. As a result, in order to provide a notched roof bolt having pre-selected mechanical properties, a roof bolt must be provided having a diameter larger than required to compensate for the reduction in diameter at the notch.

Therefore, there is a need for a bendable roof bolt having a uniform cross section which does not require notching of the roof bolt body to facilitate bending of the roof bolt. Since the roof bolt has a uniform cross section, the roof bolt may be made from a smaller diameter rebar material than the presently commercially available notched roof bolt and still exhibit mechanical properties equivalent to that of the larger diameter notched roof bolt. Since the uniform cross section roof bolt has a smaller diameter than the notched roof bolt, it is lighter in weight and is also easier to bend.

SUMMARY OF THE INVENTION

In accordance with the present invention there is provided a bendable roof bolt for use in a mine to support a mine roof that is made from a steel rebar material and has a preselected length and a uniform cross section. The rebar has an end portion arranged to be inserted in a bore hole drilled in a mine roof and an opposite end portion. The rebar preselected length is greater than the available vertical working distance between the mine floor and the mine roof into which the roof bolt is to be inserted. Since the rebar preselected length is greater than the available vertical working distance between the mine floor and the mine roof, the roof bolt is bent prior to its insertion in the bore hole. Means is provided for bending the rebar at a predetermined location along the rebar preselected length to form a rebar bent portion. Bending the rebar at a predetermined location along the rebar preselected length angularly spaces the rebar end portion from the rebar opposite end portion. Means is provided for inserting the rebar end portion in the bore hole drilled in the mine roof and advancing the rebar end portion upwardly until a portion of the bent portion abuts the mine roof adjacent the bore hole. After the end portion of the rebar is inserted in the bore hole to a depth sufficient to cause the bent portion to abut the mine roof adjacent the bore hole, the rebar is rebent to at least partially straighten the rebar bent portion and allow the remainder of the rebar to be advanced in the bore hole.

Further in accordance with the present invention there is provided a method for installing a bendable roof bolt in a bore hole to support a mine roof including the steps of providing a roof bolt made from a steel rebar material having a preselected length and a uniform cross section. The rebar preselected length is greater than the available vertical working distance between the mine floor and the mine roof. The method includes the step of bending the rebar at a predetermined location along the rebar preselected length to form a rebar bent portion. Bending the rebar angularly spaces the rebar end portions from each other. The method includes the step of inserting one rebar end portion in the bore hole and advancing the rebar end portion upwardly until a portion of the bent portion abuts the mine roof adjacent the bore hole. After the rebar end portion is inserted in the bore hole to a depth sufficient to cause the bent portion to abut the mine roof adjacent the bore hole, the rebar is rebent to at least partially straighten the rebar bent portion and allow the remainder of the rebar to be advanced in the bore hole.

Accordingly, the principal object of the present invention is to provide a roof bot made from a steel rebar material and having a uniform cross section which may be bent prior to insertion in a bore hole and rebent after a portion of the rebar is inserted in the bore hole to at least partially straighten the rebar and allow the remainder of the rebar to be advanced in the bore hole.

Another object of the present invention is to provide a bendable roof bolt for use in a mine to support a mine roof at locations where it is desired to utilize a roof bolt having a preselected length greater than the available vertical working distance between a mine floor and the mine roof into which the roof bolt is to be inserted.

These and other objects of the present invention will be more completely disclosed and described in the following specification, the accompanying drawings, in the appended claims.

DESCRIPTION OF THE PREFERRED EMBODIMENTS

Figure 1:
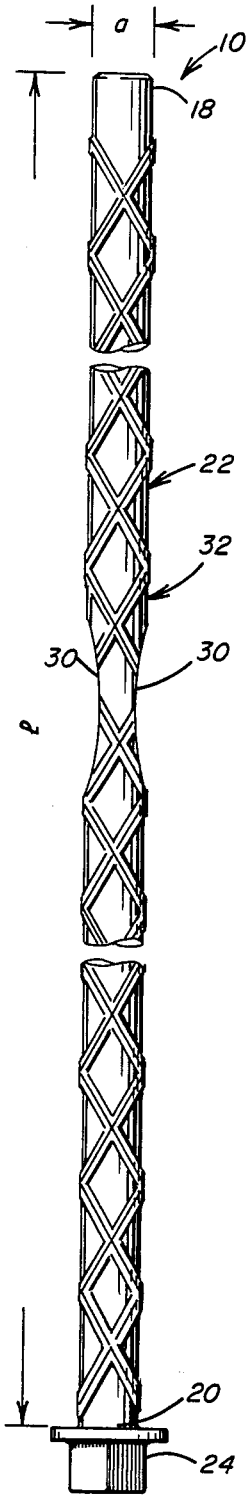
FIG. 1 is a view in side elevation of a bendable roof bolt known in the art, illustrating a pair of notches positioned in the rebar body to facilitate bending.

Referring to the drawings, and particularly to FIG. 1, there is illustrated a roof bolt generally designated by the numeral 10 which may be inserted in a bore hole 12 drilled in a rock formation 14 (illustrated in FIGS. 5–9) to support the rock formation 14 that overlies a mine passageway 16. The specific configuration of the roof bolt 10 is known in the art. Roof bolt 10 includes a pair of end portions 18, 20 and an elongated body portion 22. Typically, roof bolt 10 is made from a No. 6, Grade 40 or 60 rebar and has an enlarged head end 24 forged on elongated body portion 22 at end portion 20. Roof bolts such as roof bolt 10 made from a No. 6, Grade 40 or 60 rebar material are commercially available and have a diameter a of approximately three-quarters of an inch.

Roof bolt 10 is utilized at locations where, due to the condition or composition of rock formation 14, it is required to insert a roof bolt in a bore hole drilled in mine roof 28 which has an overall length l greater than the available vertical working distance d between the mine floor 26 and mine roof 28 (illustrated in FIGS. 5–9). Since the overall length 1 of roof bolt 10 is greater than the vertical distance d between mine floor 26 and mine roof 28, it is seen that roof bolt 10 must first be bent to reduce its overall length l before it can be inserted in the bore hole. In order to facilitate bending, roof bolt 10 is provided with a pair of notches 30. The diameter a of roof bolt 10 is reduced at notches 30 to facilitate bending of roof bolt 10. As roof bolt 10 is bent its overall length l is reduced, allowing end portion 18 to be inserted in bore hole 12 in rock formation 14 (illustrated in FIGS. 5–9). After roof bolt 10 is bend and end portion 18 inserted in bore hole 12, roof bolt 10 is advanced upwardly in the bore hole until notch 30 abuts the mine roof adjacent the bore hole. Thereafter, roof bolt 10 is straightened to allow further advancement of roof bolt 10 in bore hole 12.

As previously described, roof bolts such as roof bolt 10 are made from three-quarter inch diameter, Grade 40 or 60 rebar material and include a pair of notches 30. Although roof bolt 10 illustrated in FIG. 1 includes two notches 30 to facilitate bending, it should be understood that roof bolts are also commercially available which include only one notch 30 positioned at a preselected location along roof bolt 10 preselected length.

Roof bolt 10 may be provided with notches 30 by methods well known in the art. For example, roof bolt 10 may be heated and thereafter notches 30 pressed into the outer surface 32 of the roof bolt 10. If desired, the outer surface 32 of the roof bolt 10 may be milled, or roof bolt 10 may be subjected to a reduced rolling process to provide the pair of notches 30. Reduced rolling roof bolt 10 to form notches 30 may be done by either a hot or cold reduced rolling process.

Figure 2:
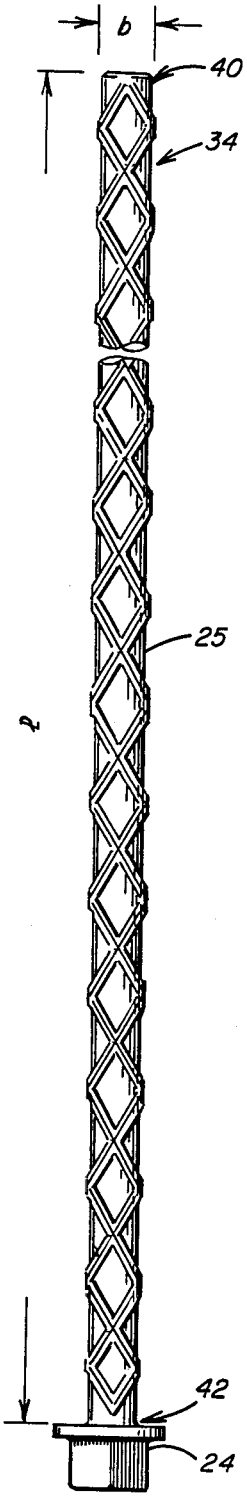
FIG. 2 is a view in side elevation of a bendable roof bolt having uniform cross section which is a subject of this invention.
Figure 3:
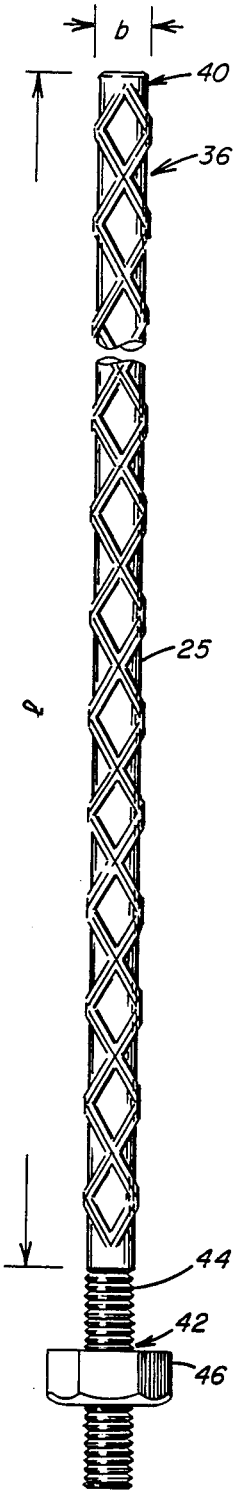
FIG. 3 is a view in side elevation of another embodiment of a bendable roof bolt having a uniform cross section which is the subject of this invention.
Figure 4:
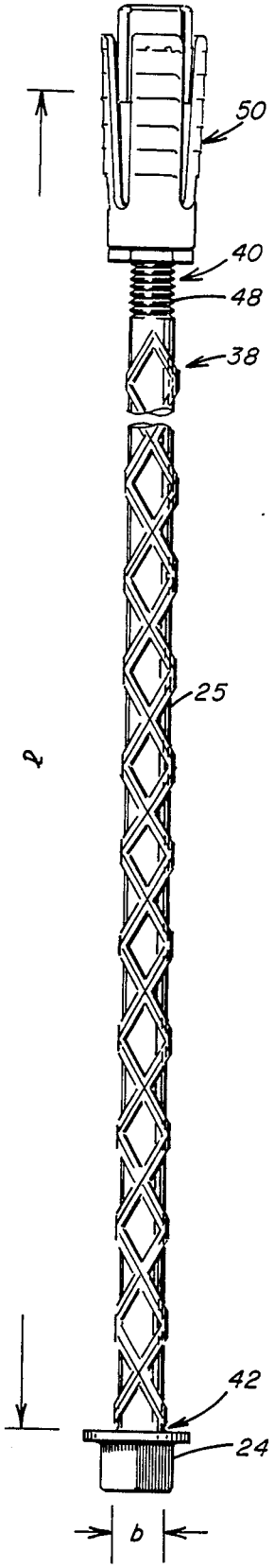
FIG. 4 is a view in side elevation of still another embodiment of a bendable roof bolt having a uniform cross section which is the subject of this invention.

Referring to FIGS. 2–4, there are illustrated bendable roof bolts 34, 36, 38 which are the subject of this invention. Roof bolts 34, 36, 38 are made from a No. 5, Grade 60 rebar material. As seen in FIGS. 2–4, each of the roof bolts 34, 36, 38 has an overall length l corresponding to the overall length l of roof bolt 10 illustrated in FIG. 1. Each of the bendable roof bolts 34, 36, 38 has a diameter b which is less than the diameter a of roof bolt 10. As seen in FIGS. 2–4, each of the bendable roof bolts 34, 36, 38 has a uniform cross section over their entire length l. As such, the bendable roof bolts 34, 36, 38 do not include notches such as the notches 30 of roof bolt 10 illustrated in FIG. 1. Preferably, roof bolts 34,36, 38 are made from a Grade 60 rebar material and have a cross sectional diameter b of five-eighths of an inch.

Roof bolts 34, 36, 38 each have a pair of end portions 40, 42. The pair of end portions 40, 42 each have a preselected configuration to suit particular application requirements. For example, roof bolts 34 and 38 illustrated in FIGS. 2 and 4 have an enlarged headed end portion 24 forged on elongated body portion 25 at end portion 42. As seen FIG. 3, the end portion 42 of roof bolt 36 includes a threaded portion 44 to accommodate a nut 46. As seen in FIG. 4, end portion 40 of roof bolt 38 includes a threaded end portion 48 for receiving a conventional expansion shell assembly 50 known in the art. As described, roof bolts 34, 36, 38 may have their end portions 40, 42 configured as required to suit particular application requirements without departing from this invention.

Roof bolts 34, 36, 38 illustrated in FIGS. 2–4 are for use in locations where, because of the unstable condition of the rock strata above the mine roof, it is required to utilize a roof bolt having an overall length which is greater than the available vertical working distance d between mine floor 26 and mine roof 28 (illustrated in FIGS. 5–9). Therefore, roof bolts, 34, 36, 38 must be bent at predetermined locations along their respective lengths before they can be inserted in bore hole 12. Although roof bolts 34, 36, 38 do not include the notches 30 of roof bolt 10 illustrated in FIG. 1, roof bolts 34, 36, 38 have a diameter b smaller than the diameter a of the roof bolt 10. As such, they are lighter in weight than roof bolt 10 and are easily bent at any predetermined location along their respective lengths by suitable means.

FIGS. 5–9 illustrate the preferred method of installing a bendable roof bolt such as roof bolt 34 illustrated in FIG. 2 in bore hole 12 to support rock formation 14. As seen in FIGS. 5–9, roof bolt 34 has an overall length l which is greater than the available vertical working distance d between mine floor 26 and mine roof 28. Roof bolt 34 is made from a No. 5, Grade 60 rebar material and has a uniform cross sectional diameter b of five-eighths of an inch.

Figures 5, 6, 7, 8, 9:
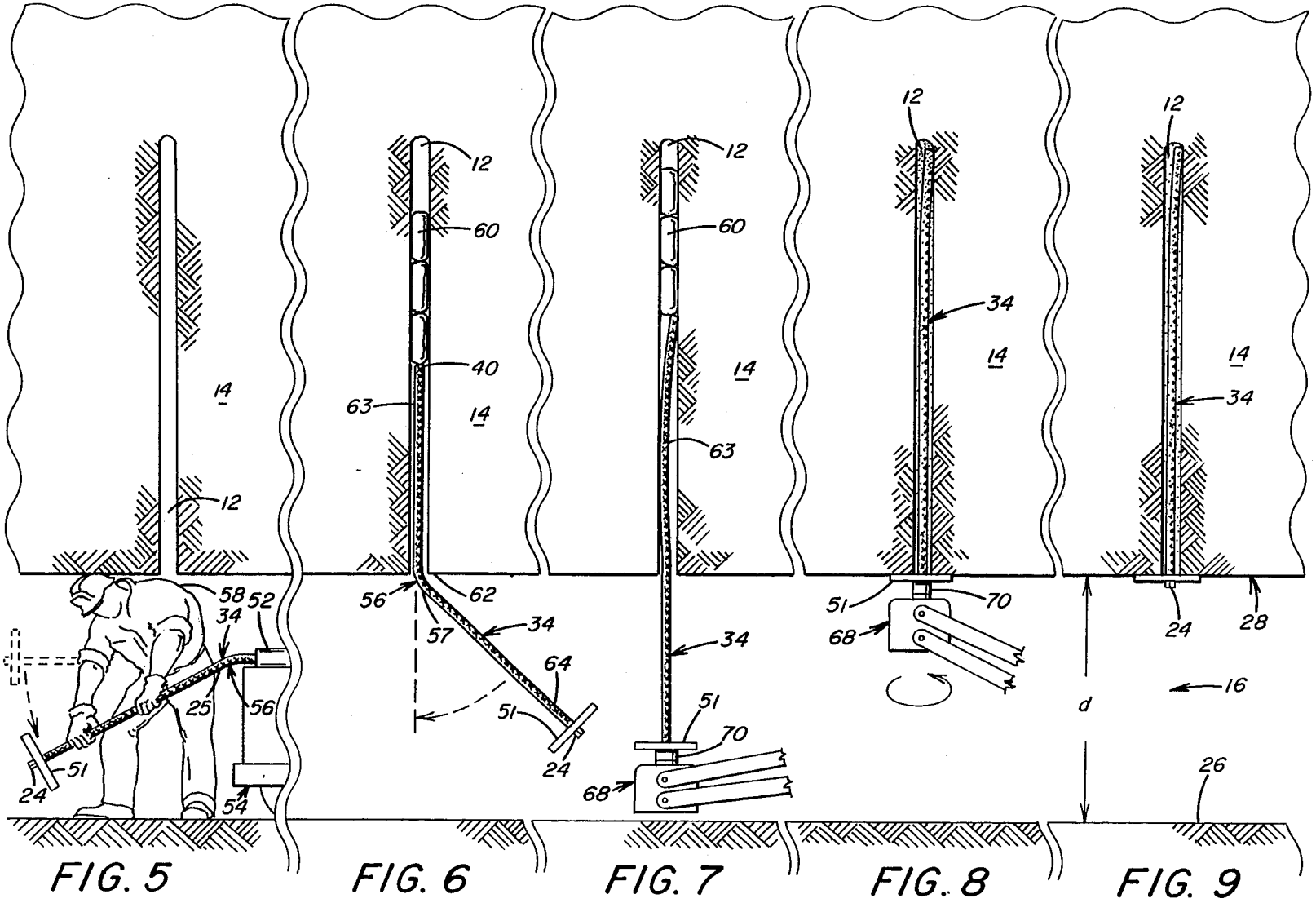
FIG. 5 is a partial sectional view in side elevation illustrating a mine operator bending a uniform cross section roof bolt prior to inserting the roof bolt in a bore hole.
FIG. 6 illustrates the step of inserting a portion of the uniform cross section roof bolt in a bore hole drilled in a mine roof.
FIG. 7 is a view similar to FIGS. 5 and 6, illustrating a further step of partially straightening the uniform cross section roof bolt after a portion of the roof bolt is inserted in a bore hole.
FIG. 8 illustrates a further step of thrusting a partially straightened roof bolt upwardly in a bore hole to rupture resin cartridges positioned at the blind end of the bore hole and rotating the bendable roof bolt to effect mixing of the contents of the resin cartridge.
FIG. 9 is a view similar to FIG. 8, illustrating a bendable roof bolt having a uniform cross section fully inserted in a bore hole drilled in a mine roof and maintained in position within the bore hole by a cured resin mixture.

As seen in FIG. 5, a conventional roof support plate 51 is positioned on roof bolt 34 in abutting relation with roof bolt 34 enlarged headed end portion 24. Roof bolt 34 is inserted into a pipe member 52 secured to mining machine 54 by operator 58. Since a portion of roof bolt 34 is retained with pipe section 52, as operator 58 exerts a downward force on the portion of roof bolt 34 extending outwardly from pipe section 52, roof bolt 34 is bent to provide roof bolt 34 with a bent portion 56. It should be understood that roof bolt 34 may be inserted any preselected distance into pipe section 52 to vary the location of bent portion 56 along outer wall 25. Although FIG. 5 illustrates a method of bending roof bolt 34 by inserting a portion of roof bolt 34 in pipe section 52 and exerting a downward force on roof bolt 34, any suitable method of bending roof bolt 34 may be utilized without departing from this invention.

After roof bolt 34 is bent by operator 58, roof bolt 34 is removed from pipe member 52 and inserted in bore hole 12 drilled in mine roof 28 as illustrated in FIG. 6. As seen in FIG. 6, a plurality of breakable cartridges 60 are inserted in bore hole 12 ahead of roof bolt 34 end portion 40. The plurality of breakable cartridges 60 each contain a conventional two component bonding material, such as disclosed in U.S. Pat. Nos. 3,324,662 and 3,394,527. As will be explained later in greater detail, after roof bolt 34 is partially straightened and advanced upwardly within bore hole 12, the plurality of cartridges 60 are ruptured by end portion 40 and the components therein are released. The components are mixed by rotation of roof bolt 34 to effectively resin bond roof bolt 34 within bore hole 12 after the bonding material cures.

As seen in FIG. 6, roof bolt 34 is advanced upwardly in bore hole 12 until a portion of bent portion 56 abuts mine roof 28 at bore hole 12 edge portion 62. As described, roof bolt 34 is initially restrained from complete upward advancement in bore hole 12 since roof bolt 34 bent portion 56 abuts bore hole 12 edge portion 62.

After roof bolt 34 end portion 40 is initially inserted in bore hole 12 and roof bolt 34 advanced upwardly until bent portion 56 abuts bore hole 12 edge portion 62, the portion 64 of roof bolt 34 which extends beneath mine roof 28 is rebent by suitable means to partially straighten roof bolt 34. For example, operator 58 may partially straighten roof bolt 34 by grasping roof bolt 34 extending portion 64 and exerting a force on extending portion 64 to bring extending portion 64 into substantial alignment with portion 63 of roof bolt 34 initially positioned in bore hole 12. If desired, roof bolt 34 may be partially straightened using any mechanical device or equipment located within the mine.

Referring to FIG. 7, it can be seen that partially straightening roof bolt 34 imparts a slight bow to bolt portion 63 of roof bolt 34 initially positioned within bore hole 12 above bent portion 56. As seen in FIGS. 6 and 7, as a suitable straightening force is exerted on portion 64 of roof bolt 34 extending beneath mine roof 28, bolt portion 63 will pivot within bore hole 12 until end portion 40 and outside surface 57 of bent portion 56 each contact the wall of bore hole 12 at locations opposed from each other on the circumference of roof bolt 34. Applying a suitable straightening force to roof bolt 34 urges end portion 40 and the outside surface 57 of bent portion 56 into contact with the wall of bore hole 12 at locations opposed from each other on the circumference of roof bolt 34 to cause bolt portion 63 to bow or bend.

As seen in FIG. 7, the straightening operation provides a roof bolt 34 having a bowed portion 63 and an end portion 40 which contacts the wall of bore hole 12. After partial straightening, the full length of roof bolt 34 may be advanced upwardly in bore hole 12. Any suitable means may be utilized for providing upward thrust to roof bolt 34 for insertion in bore hole 12. As illustrated in FIG. 7, a bolter pod 68 may be utilized to advance roof bolt 34 upwardly in bore hole 12. Bolter pods such as bolter pod 68 are known in the art and having a rotating socket assembly 70 for receiving the enlarged headed end portion 24 of roof bolt 34. After roof bolt 34 headed end portion 24 is inserted into rotating socket assembly 70 of bolter pod 68, bolter pod 68 is moved vertically within mine passageway 16 by means well known in the art to thrust roof bolt 34 upwardly into bore hole 12 to rupture the plurality of breakable resin cartridges 60 positioned within the blind end of bore hole 12 and release the components contained therein.

As seen in FIG. 8, after roof bolt 34 is thrust upwardly within bore hole 12 by bolter pod 68 to rupture the plurality of breakable cartridges 60, roof bolt 34 is rotated within bore hole 12 by rotation of socket assembly 70. As socket assembly 70 rotates, the thermosetting resin and catalyst released from breakable cartridges 60 are mixed to form a curable resin mixture within bore hole 12. As roof bolt 34 is rotated continuously in the direction indicated by the arrow in FIG. 8 to effect mixing of the resin, the resin mixture begins to cure or harden in bore hole 12. As roof bolt 34 rotates, the curable resin mixture flows into the fissures and faults in rock formation 14 surrounding bore hole 12. In this well known manner, the rock strata are adhesively united to further reinforce rock formation 14. As the resin mixture begins to harden or cure in bore hole 12, the resin mixture surrounding roof bolt 34 maintains roof bolt 34 in position within bore hole 12. Although a specific rotational direction is illustrated in FIG. 8, it should be understood that roof bolt 34 may be rotated in either a clockwise or counter-clockwise direction to effect mixing of the resin and catalyst.

As seen in FIG. 9, after the resin mixture sufficient cures or hardens in bore hole 12 to retain roof bolt 34 within bore hole 12, bolter pod 68 is removed from the enlarged headed end portion 24 of roof bolt 34 and installation of bendable roof bolt 34 within bore hole 12 is complete.

Although FIGS. 5–9 illustrate installation of roof bolt 34 within bore hole 12, it should be understood that bendable roof bolts such as roof bolt 36 illustrated in FIG. 3 and roof bolt 38 illustrated in FIG. 4 may also be inserted in bore hole 12 in the manner herein described. Roof bolts having a uniform cross section and an overall length l which is greater than the available working distance d between the mine floor 26 and mine roof 28 may be inserted into a bore hole 12 drilled in mine roof 28 by bending the roof bolt at a preselected location along its preselected length to permit at least a portion of the roof bolt to be inserted in the bore hole. After a portion of the roof bolt is inserted in the bore hole, the roof bolt is rebent to partially straighten the roof bolt and allow the remainder of the roof bolt to be inserted in the bore hole.

As described herein, a roof bolt having a uniform cross section and a length l greater than the available vertical working distance d between mine floor 26 and mine roof 28 may be initially bent, a portion of the roof bolt inserted in bore hole 12 drilled in mine roof 28, and thereafter rebent or partially straightened to allow the roof bolt to be installed completely within bore hole 12. The roof bolts described herein, such as roof bolts 34, 36, 38 illustrated in FIGS. 2–4, all have a uniform cross section. Specifically each of the roof bolts 34, 36, 38 have and uniform cross sectional diameter of five-eighths of an inch and are made from a No. 5, Grade 60 rebar material which is well known in the art.

Although the diameter b of the roof bolts 34, 36 and 38 illustrated in FIGS. 2–4 is smaller than the diameter a of the prior art notched roof bolt 10 illustrated in FIG. 1, roof bolts 34, 36 and 38 exhibit mechanical characteristics greater than the mechanical characteristics of prior art roof bolt 10 since roof bolts 34, 36, 38 have a uniform cross section.

The following examples are illutrative of the instant invention.

EXAMPLE 1

Four three-quarter inch diameter (No. 6) bendable roof bolts made from a Grade 40 rebar material each having an overall length of 48 inches and one notch positioned at the center of the bolt were provided (prior art roof bolt 10 illustrated in FIG. 1 but having only one notch). Due to the notching of these roof bolts, the four No. 6 roof bolts averaged a diameter of 0.445 inch at the area of the notch. Each of the four No. 6 roof bolts was bent at the notch to determine the amount of torque required to bend each bolt 60°. The four No. 6 roof bolts required an average of 119 foot-pounds for a 60° bend, with bolt No. 3 requiring a minimum of 100 foot-pounds and bolt Nos. 1, 3 and 4 requiring a maximum of 125 foot-pounds.

Four five-eighth inch diameter (No. 5) bendable roof bolts made from a Grade 60 rebar material each having an overall length of 48 inches and no notch were also provided (roof bolts 34, 36, 38 illustrated in FIGS. 2–4). Each of the four No. 5 rebar roof bolts was bent 24 inches from an end of the bolt to determine the amount of torque required to bend each bolt 60°. The four No. 5 roof bolts required an average of 187 foot-pounds for a 60° bend, with bolt No. 1 requiring a minimum of 150 foot-pounds and roof bolt No. 4 requiring a maximum of 225 foot-pounds.

EXAMPLE 2

After the four Grade 40, three-quarter inch diameter (No. 6) bendable roof bolts with notch were subjected to the 60° bend test as set forth in Example 1, each of the four three-quarter inch diameter (No. 6) roof bolts was subjected to a shear test. The four Grade 60, five-eighth inch diameter (No. 5) bendable roof bolts without notch were also subjected to a shear test after the 60° bend test was completed. The four three-quarter inch diameter Grade 40 roof bolts with notch sustained an average maximum load of 16,430 pounds before shearing, with bolt No. 2 shearing at the lowest maximum load of 15,420 pounds and bolt No. 3 shearing at the highest maximum load of 17,010 pounds. The four five-eighth inche diameter Grade 60 roof bolts without notch sustained an average maximum load of 21,540 pounds before shearing, with bolt No. 2 shearing at the lowest maximum load of 20,670 pounds and bolt No. 3 shearing at the highest maximum load of 22,180 pounds.

EXAMPLE 3

After the four Grade 40, three-quarter inch diameter (No. 6) bendable roof bolts with notch and the four Grade 60, five-eighth inch diameter (No. 5) bendable roof bolts without notch were subjected to the shear test of Example 2, sheared sections of each of the four Grade 40 bolts and sheared sections of each of the Grade 60 bolts were subjected to tension tests. The average diameter of the four Grade 40 sheared sections measured 0.711 inch, and the average diameter of the four Grade 60 sheared sections measured 0.594 inch. The four Grade 40 sheared sections tested had an average yield strength of 58,200 pounds per square inch and an average ultimate strength of 88,450 pounds per square inch. Of the four Grade 40 No. 6 bolt sections tested, bolt No. 4 had a minimum yield strength of 57,900 pounds per square inch, and bolt No. 1 had a minimum ultimate strength of 87,900 pounds per square inch. The four Grade 40 No. 6 bolt sections subjected to the tension test averaged an elongation of 1.88 inches, or 23.4%, over a gage length of 8 inches.

The four Grade 60 sheared sections tested had an average yield strength of 68,625 pounds per square inch and an average ultimate strength of 108,775 pounds per square inch. Of the four Grade 60 No. 5 bolt sections tested, bolt No. 4 had a minimum yield strength of 67,900 pounds per square inch and also had a minimum ultimate strength of 108,100 pounds per square inch. The four Grade 60 No. 5 bolt sections subjected to the tension test averaged on elongation of 1.39 inches, or 17.4% over a gage length of 8 inches.

According to the provisions of the Patent Statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A bendable roof bolt for use in a mine to support a mine roof comprising, a grade 60 rebar having a preselected length and a uniform cross sectional diameter of about five-eighths of an inch, said rebar having an end portion arranged to be inserted in a bore hole drilled in a mine roof and an opposite end portion, said rebar preselected length being greater than the distance between said mine roof and the floor of said mine, means for manually bending said rebar at a predetermined location along said rebar preselected length to form a bent rebar with a bent portion, said end portion of said bent rebar spaced angularly from said opposite end portion, means for inserting said bent rebar end portion in said bore hole and advancing said bent rebar in said bore hole until a portion of said bent portion abuts said mine roof adjacent said bore hole, and means for manually rebending said bent rebar at said predetermined location along said rebar preselected length after said rebar end portion is inserted in said bore hole to at least partially straighten said rebar bent portion and allow said rebar to be advanced in said bore hole.

2. A bendable roof bolt for use in a mine to support a mine roof as set forth in claim 1 in which, said rebar has a uniform cross sectional diameter of about five-eighths of an inch over the entire length of said rebar.

3. A bendable roof for use in a mine to support a mine roof as set forth in claim 1 in which, said rebar end portion is angularly spaced from said rebar opposite end portion as said rebar is bent to form said rebar bent portion having an incuded angle of less than 90°.

4. A bendable roof bolt for use in a mine to support a mine roof as set forth in claim 1 in which, said rebar opposite end portion is threaded to receive a nut.

5. A bendable roof bolt for use in a mine to support a mine roof as set forth in claim 1 wherein, said rebar opposite end portion includes an enlarged headed end portion.

6. A bendable roof bolt for use in a mine to support a mine roof as set forth in claim 1 in which, said rebar end portion is threaded to receive an expansion shell assembly.

7. A method for installing a bendable roof bolt in a bore hole to support a mine roof comprising the steps of, providing a rebar having a preselected length and a uniform cross section, said preselected length being greater than the vertical distance between said mine roof and the mine floor, said rebar including a pair of end portions, manually bending said rebar at a predetermined location along said rebar preselected length to form a bent rebar with a bent portion, said end portions of said bent rebar being spaced angularly from each other, inserting said bent rebar in said bore hole until a portion of said bent portion abuts said mine roof adjacent said bore hole, and manually rebending said bent rebar at said predetermined location along said rebar preselected length after said bent rebar is inserted in said bore hole to at least partially straighten said rebar bent portion and allow said rebar to be advanced in said bore hole.

8. A method for installing a bendable roof bolt in a bore hole to support a mine roof as set forth in claim 7 including, bending said rebar at said predetermined location along said rebar preselected length so that said rebar end portions are angularly spaced from each other by an included angle of less than 90°.

9. A method for installing a bendable roof bolt in a bore hole to support a mine roof as set forth in claim 7 including, providing a rebar having a uniform cross sectional diameter of five-eighths of an inch.

* * * * *